US005535613A

United States Patent [19]

Yano

[11] Patent Number: 5,535,613

[45] Date of Patent: Jul. 16, 1996

[54] DEVICE FOR MOVING A BLOWING AND SPRAYING ASSEMBLY FOR DIES OF A FORGING PRESS

[75] Inventor: Yoshitaka Yano, Osaka, Japan

[73] Assignee: Kurimoto, Ltd., Osaka, Japan

[21] Appl. No.: 249,986

[22] Filed: May 27, 1994

[30] Foreign Application Priority Data

Jun. 7, 1993 [JP] Japan ..... 5-164243

[51] Int. Cl.[6] ..... B21B 45/02; B21C 43/00; B21D 37/16

[52] U.S. Cl. ..... 72/342.3; 72/39; 72/43; 72/40

[58] Field of Search ..... 72/39, 41, 43, 72/44, 45, 342.3; 74/522, 834

[56] References Cited

U.S. PATENT DOCUMENTS

| | | | |
|---|---|---|---|
| 2,699,119 | 1/1955 | Healey | 74/834 |
| 3,633,651 | 1/1972 | Ruhlandt | 164/267 |
| 4,196,829 | 4/1980 | Seaton | 74/834 |
| 4,234,107 | 11/1980 | Gernlein | 74/834 |
| 4,520,643 | 6/1985 | Werner et al. | 72/39 |

*Primary Examiner*—Lowell A. Larson
*Assistant Examiner*—Rodney A. Butler
*Attorney, Agent, or Firm*—Jones, Tullar & Cooper

[57] ABSTRACT

A device for moving a blowing and spraying assembly for dies used in a forging press freely adjusts the movement of the blowing and spraying assembly. The distance from an intermediate fulcrum P of a driving lever 2 having a certain length L to a pressure receiving roller 21 located at one end of the lever 2 being in contact with a slide 11 is established as L1, and a distance from the fulcrum P to an engagement ring 31 located at another end of the lever 2 is established as L2. The distances L1 and L2 can be freely adjusted by changing the position of the point P. The engagement ring is engaged with a linkage 5 through a connecting part 4, and a driven lever 51 of the linkage is connected to the spray blower. When changing the ratio of L1 to L2, an inclination θ1 of the driving lever is increased or decreased, and this variation of the inclination causes an inclination θ2 of a driven lever to change, whereby a stroke S of a jet 61 on the top end of the spray blower is changed. For replacing a die after completing one lot of forging, the function of spray blowing may be simply adjusted so as to achieve an optimum lubrication and cooling.

2 Claims, 6 Drawing Sheets

DEVICE FOR MOVING A BLOWING AND SPRAYING ASSEMBLY FOR DIES OF A FORGING PRESS

BACKGROUND OF THE INVENTION

1. Field of the Invention

The present invention relates to a device for blowing and spraying upper and lower dies used in a forging press, particularly in high speed automatic presses such as transfer presses.

2. Prior Arts

Among various types of forging presses, in certain types used for manufacturing efficiently a large amount of forged products at high speed such as transfer presses provided with a lifting beam, it has been conventionally required for dies held between upper and lower die holders to be cooled, cleaned and lubricated for the purpose of retaining a certain product quality and/or preventing the dies from being deformed. That is, it is an essential requirement of smooth operation that a blowing and spraying assembly is moved into a gap of the die space formed just after moving a slide up and securing the upper die holder, so that a fluid may be sprayed or jetted from a jet nozzle to the surface of the dies thereby blowing scales away, cooling and lubricating the die surface. In this respect, various methods for moving the blowing and spraying assembly have been heretofore proposed and actually put into practical use. Under the background of recent demand for high speed operation of forging presses and the need to increase the frequency of moving the slide up and down, the construction of the blowing and spraying assembly to move quickly in conformity with the timing of the up and down movement of the slide has become one of the technical problems to be solved.

Several attempts have been proposed in order to solve this problem. The Japanese Laid-Open Patent Publication (unexamined) No. 54-124867 discloses a mechanism for moving a blowing and spraying assembly in and away from a die space of a forging press by operating a crank arm, and in which, as shown in FIG. 6 herein, a quadric linkage 5*a* is connected to a crank chain 101 mounted on a bed, and a blowing and spraying assembly 6*a* is connected to the linkage.

The U.S. Pat. No. 4,520,643 discloses a construction in which, as shown in FIG. 7 herein, movement of a blowing and spraying assembly is not dependent upon a separate drive source, but a driving force receiving directly from a lifting motion of a slide 11*b* by an angle lever 2*b* of a quadric link 5*b*, which pivots the blowing and spraying assembly 6*b*.

The Japanese Laid-Open Utility Model Publication (unexamined) No. 56-80933 discloses a construction in which, to form a drive source for driving a blowing assembly, a slide is not employed, but one end of a crank lever is engaged with a cam mounted on a transfer beam and the blowing and spraying assembly is engaged with another end of the lever, whereby movement of the beam is associated with movement of the blowing and spraying assembly.

In any of the above-mentioned prior art device, the blowing and spraying assembly is automatically moved forward and backward either directly in association with operation of the forging press or through a separate drive source, whereby the die is cooled and lubricated synchronously with the opening and closing of the die space.

It may be said that any of the above-mentioned prior art devices succeeds in overcoming the inefficiency of performing the required cooling, cleaning and lubrication of the die manually by an operator using a hand pistol spray or the like, thus mechanizing a series of operations and improving working performance.

In this regard, it is a matter of course that dimensions of every part of a forging press are determined on the basis of certain design elements, and operation of the press is achieved in accordance with functions determined by those dimensions. For example, the stroke of moving the slide up and down is constant or fixed for one forging press and never changed unless otherwise any special structural change is introduced. It is, however, to be noted that products to be manufactured by one forging press are not always fixed, but usually involve manufacturing several different types of products even in a working day. As a result, a die as well as a die holder holding the die is obliged to be replaced to meet each of the different types of products. Since the shape and dimensions of products are largely different, i.e., spherical, square, semicircular, round or square bar-like, etc., the die for forming such products as well as the die holder thereof must be changed to be square, round or rectangular in their mounting face. Thus, it is usually arranged that, though dimensions and shape of a slide of one forging press are fixed, the size of a die holder attached to the lower end of the press is varied enough to meet the different sizes of the products.

As mentioned above, the dimensions of the respective members as well as the specification of the combination thereof are already fixed at the design stage of a forging press before manufacturing thereof. Therefore, when driving a blowing and spraying assembly for interlocking with a slide or transfer beam which merely repeats a predetermined operation, the blowing and Spraying assembly will also merely repeat a predetermined locus. Since the shape of the die and the die holder subject to blowing and spraying may vary largely as mentioned above, there is a case wherein entire surface area of a die which actually needs cooling, cleaning and lubrication is not always completely cooled, cleaned and lubricated through such a limited predetermined locus of the blowing and spraying assembly, but a certain dead angle where cooling, cleaning and lubrication is not performed may take place. Moreover, there is a possibility that, with a stroke of a blowing and spraying assembly which was predetermined as the greatest common measure, a part of a movable member such as a the first lever of a linkage collides with a die holder, if large size die holders are attached to a slide. To prevent such a collision, the size of the die holders and/or the size of the products may be obliged to be restricted.

In any of the foreging prior art devices, when it is intended to change a predetermined stroke of a blowing and spraying assembly, a problem exists in that the incorporated quadric linkage itself must be essentially changed, which means that the entire device for moving the blowing and spraying assembly must be essentially rearranged, resulting in a considerable cost far from an economically acceptable solution.

SUMMARY OF THE INVENTION

The present invention solves the above-discussed problems and has as an object of providing a device for moving a blowing and spraying assembly for dies in which not only the stroke for moving the blowing and spraying assembly into a die space can be adjusted as desired, but also moving the length of the top end of the blowing and spraying assembly from the stroke center is adjustable so as to conform to the size of a new introduced die holder.

To accomplish the foregoing object, a device for moving a blowing and spraying assembly for dies used in forging presses in accordance with the present invention comprises a mechanism for moving a top end of the blowing and spraying assembly 6 for blowing and spraying a die lubricant through a linkage in a form of receiving a motion of a slide 11 of a forging press 1 by a driving lever 2, and in which the ratio of a distance L1 from an intermediate fulcrum P of the driving lever 2 having a certain full length L to a roller 21 located at one end of the driving lever 2 being in close contact with the slide 11, to a distance L2 from the fulcrum P to an engagement ring 31 located at another end to engage with a connecting part 4 of a linkage 5 is adjustable.

FIGS. 4 (A) and 4 (B) are respectively functional diagrams for explaining the function of the present invention. In FIG. 4 (A), the full length L of the axis of the driving lever 2 is constant at all times, and one end thereof is provided with a pressure receiving roller 21 at a distance L1 from the intermediate fulcrum P to the one end. The mentioned pressure receiving roller is urged at all times so as to be in close contact with the slide 11 of the forging press at an action point Q, and accordingly performs upward and downward motion of the slide and turning motion round the fulcrum P at an angle θ1.

Another end of the driving lever is engaged with the connecting part 4 of the linkage 5, whereby a reaction point R distant from the fulcrum P by the distance L2 is formed. This motion is transmited to the linkage 5 through the connecting part, and a driven lever 51 repeats a turning motion at an angle θ2, whereby the blowing and spraying assembly 6 attached to the top end of the driving lever 51 is changed over to perform a motion for moving longitudinally (leftward and righward), and thus a stroke S of the movement of the top end of the blowing and spraying assembly 6 is determined.

FIG. 4 (B) shows a variation in operation of the device according to the present invention when the surface area of the die, to which a lubricant is to be sprayed, must be changed due to the dimensions and shape of the products largely different from the prevously manufactured products or when there is a possibility that the top end of the blowing and spraying assembly 6 collides with a die holder, if replacing a die with a new one after completing a lot of forging with that die. In this operation, the full length L of the driving lever is constant, but when shifting the intermediate fulcrum P a little toward the action point Q side, L1 is shortened while L2 is extended, whereby a turning angle of the driving lever is increased to θ1+Δθ1. As a result, a turning angle of the driven lever 51 is increased to θ2+Δθ2, whereby a stroke for moving longitudinally (leftward and rightward) the top end of the blowing and spraying assembly 6 become extended.

Thus, in the device for moving a blowing and spraying assembly for a die according to the present invention, the stroke of the blowing and spraying assembly can be easily adjusted in conformity with the dimensions and shape of a die holder for holding the die without replacing the entire linkage. Accordingly, being different from the prior art, the possiblity of collision of the driven lever with the end face of die holder bringing about a working trouble is avoided. Furthermore, the mentioned disadvantage of restricting the dimensions and/or shape of the die or the die holder to avoid formation of a dead angle, where cleaning and cooling of a die of large width is impossible with a stroke predetermined on the basis of the greatest common measure in the prior arts, is also overcome. More specifically, the stroke can be easily extended or shortened as far as an adjusting liner corresponding to an expected variation of stroke of the blowing and spraying assembly is prepared. The distance of moving the assembly into a die space from the center of the die can also be adjusted in conformity with the variation of the die surface. The mentioned dualistic position adjustment is a superior function which has never existed in the prior art, and contributes considerably to continuous appropriate operation control of a forging press with high efficiency.

Other objects, features and advantages of the present invention will become apparent in the course of the following description with reference to the accompanying drawings.

DESCRIPTION OF THE PREFERRED EMBODIMENT

Figure 1:
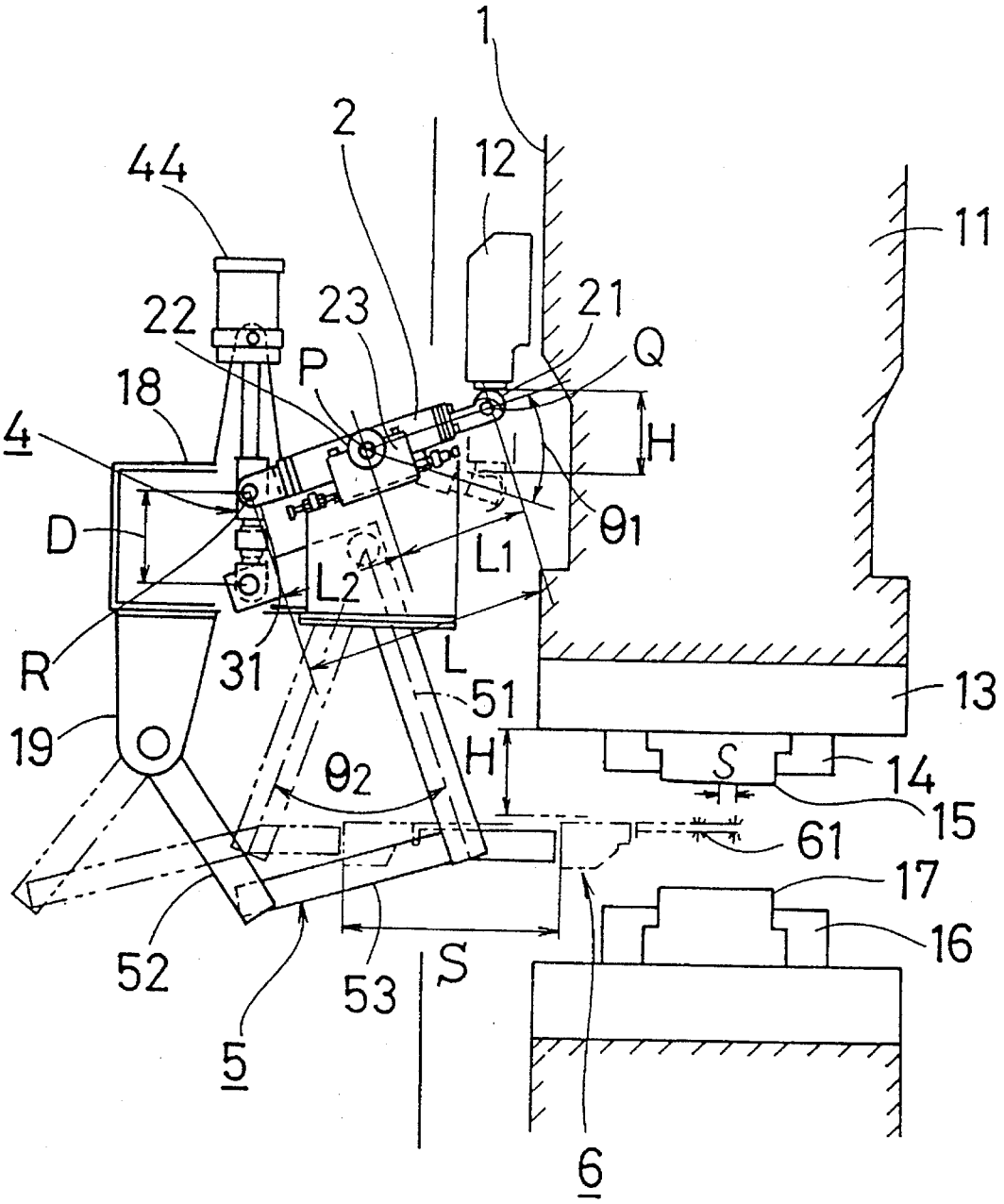
FIG. 1 is a front view showing an embodiment according to the present invention.
Figure 2A:
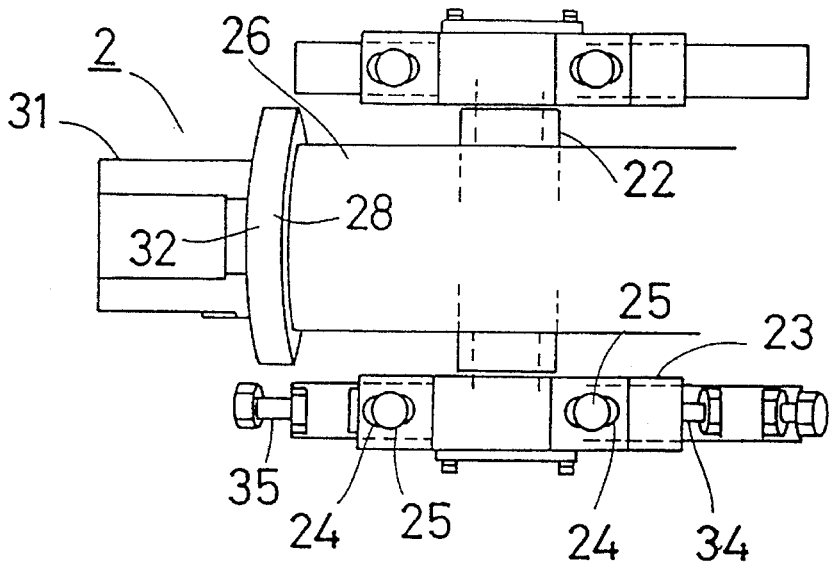
FIG. 2 (A) and FIG. 2 (B) are respectively a plan view and a front view showing an essential part of the embodiment of FIG. 1.
Figure 2B:
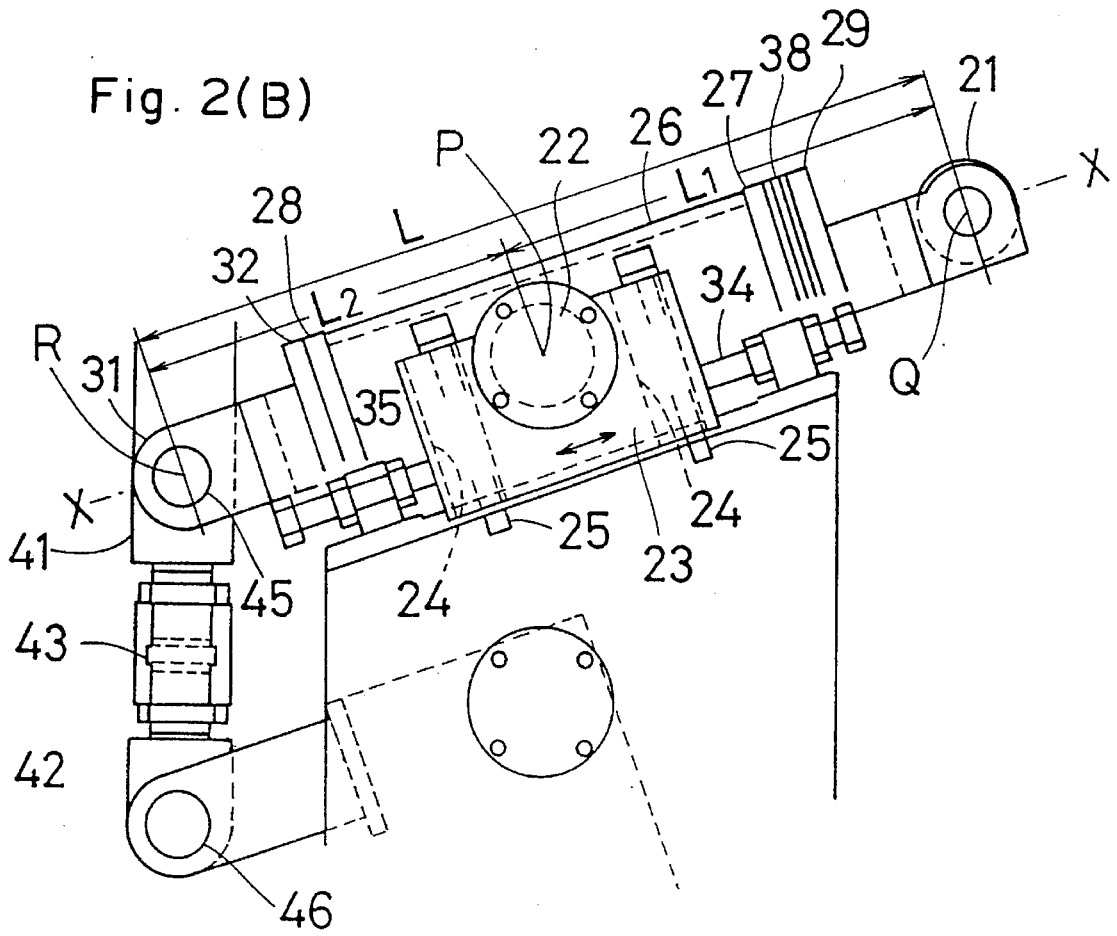
Figure 3:
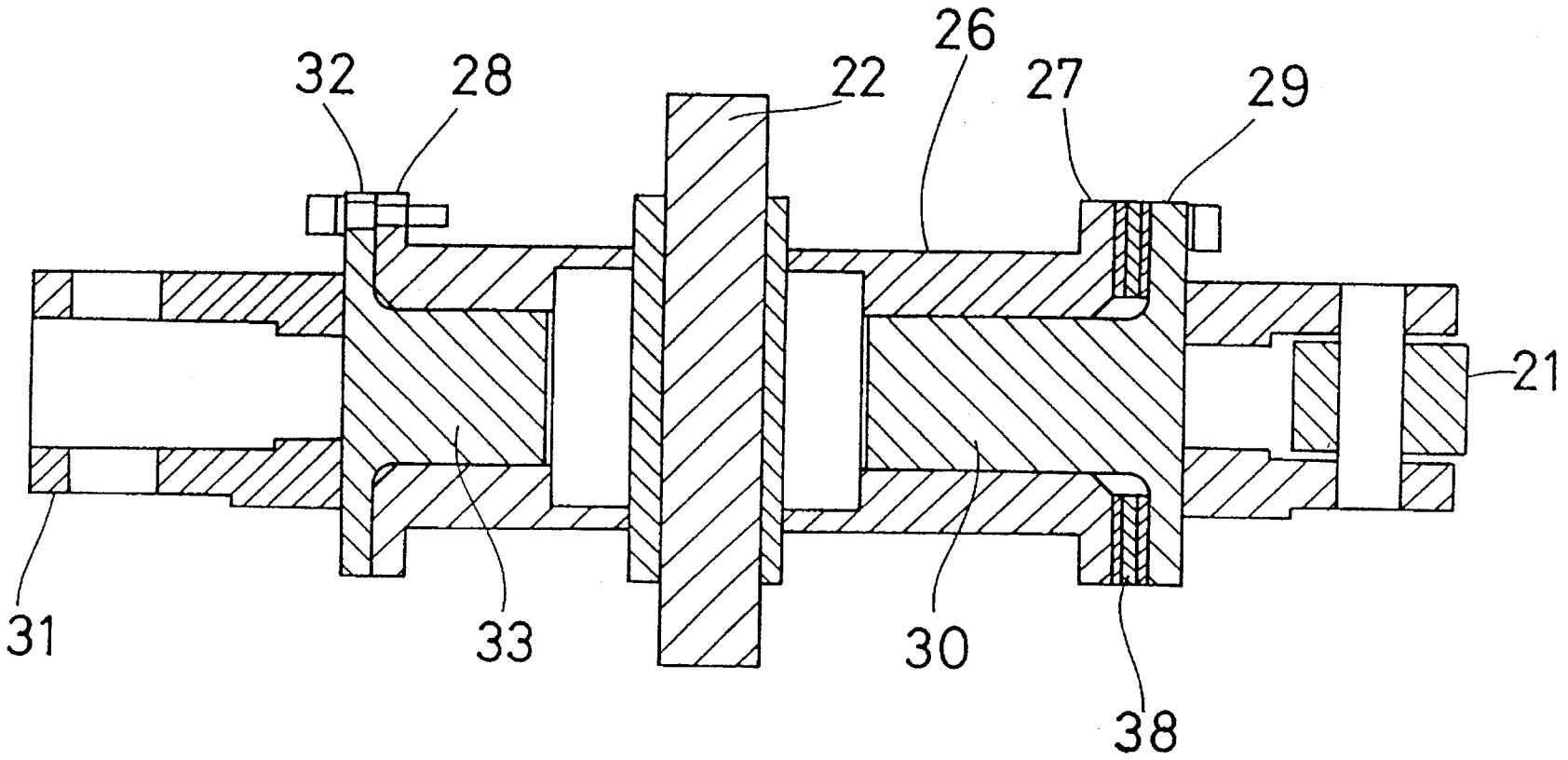
FIG. 3 is a sectional view taken along the line X—X in FIG. 2 (B)
Figure 4B:
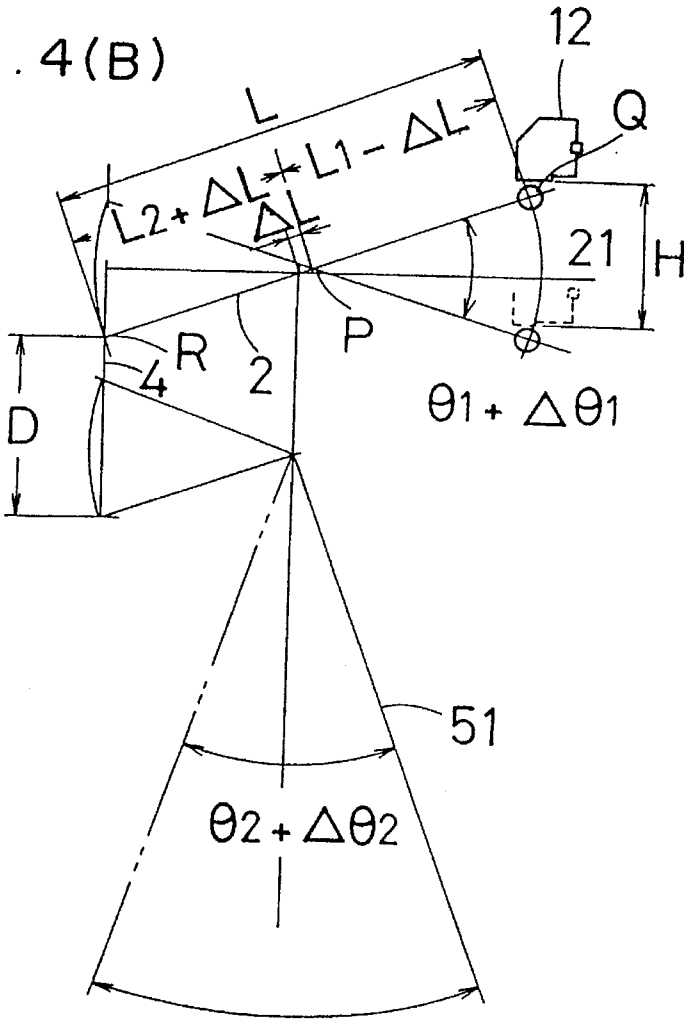
FIG. 4 (A) and FIG. 4 (B) are function diagrams for explaining the adjustment function of the stroke of a blowing and spraying assembly according to the present invention.
Figure 4:
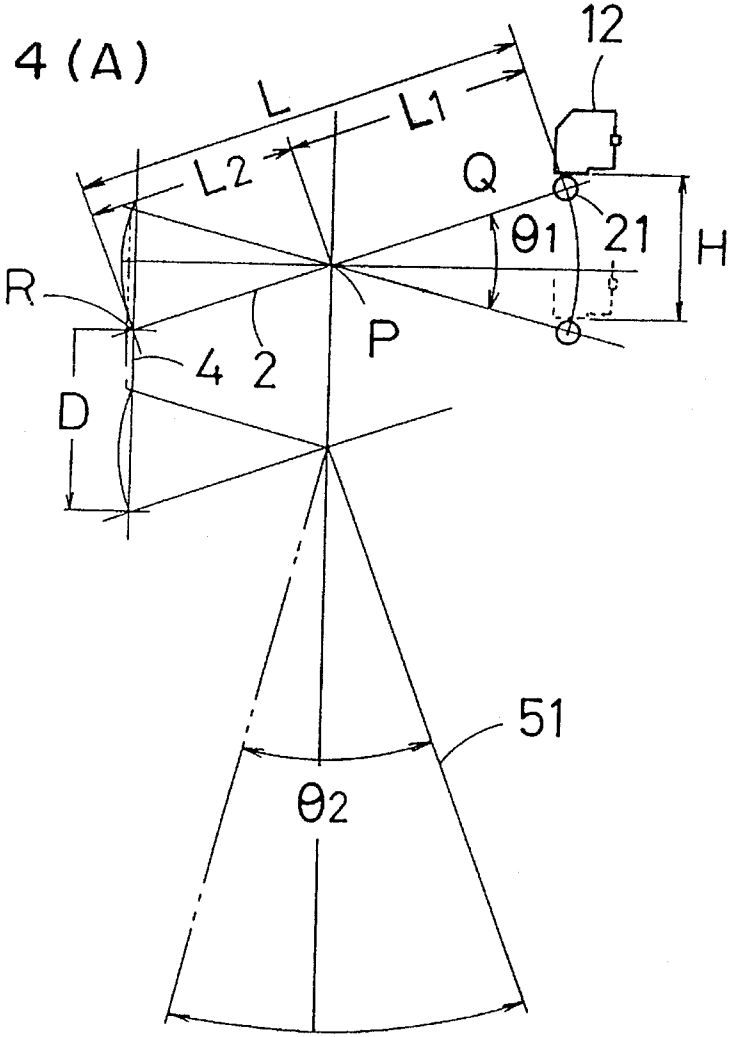

FIG. 1 shows a front view illustrating an entire embodiment of the present invention, and FIGS. 2 (A) and 2 (B) show respectively a plan view and a front view showing a stroke conversion mechanism of a blowing and spraying assembly mainly comprised of a driving lever and a connecting part. FIG. 3 shows a sectional view taken along the line X—X in FIG. 2 (B). A slide 11 of a forging press 1 is provided with a kicker 12, and a pressure receiving roller 21 mounted at one end of a driving lever 2. The roller 21 is urged upward and pressed against the surface of the kicker 12 at all times as a reaction from an air cylinder 44 which is urged downward at all times through an engagement ring 31 located at another end of the driving lever 2. Accordingly, the motion of moving the slide up and down with a constant stroke H is converted, without fail, to a turning motion of the driving lever 2. An upper die holder 14 is mounted on the lower part of the slide 11 of the forging press through an upper bolster 13, and further an upper die is mounted on the upper die holder 14. A lower die holder 16 is mounted on a bed of the forging press through a lower bolster, and a lower die 17 is fitted in the lower die holder 16.

A linkage 5 connecting to connecting part 4, on the one hand, and the blowing and spraying assembly 6, on the other hand, comprises a driven lever 51 rotatably engaged with a connecting fitting 42 through a pin 46, a link 52 rotatably engaged with a bracket 19 mounted on a frame 18 being outside the blowing and spraying assembly, and a link 53 connecting the driven lever 51 to the link 52. The blowing and spraying assembly 6 is supported on a top end of the driven lever 51 so as to convert a turning motion of the driven lever 51 to a longitudinal motion of the assembly 6, whereby the blowing and spraying assembly 6 moves in and out of a die space formed between the two dies at a stroke S determined on the basis of a ratio of L1 to L2 as mentioned above.

FIGS. 2 and 3 show the driving lever and the connecting part in detail, illustrating a mechanism for performing the stroke adjustment function for the blowing and spraying assembly which is a gist of the present invention. In these drawings, a slide bearing 23 holding an intermediate support shaft 22 having an intermediate fulcrum P as an axis is provided with fastening bolts 25 respectively inserted in elongated through holes 24 provided through the slide bearing 23. A cylindrical body 26 of the driving lever 2 with its two ends provided with flanges 27, 28 is, on the one hand, projectingly provided with a the pressure receiving roller 21 and accommodates therein a cylinder 30 provided with a flange 29 to be coupled directly or indirectly with the mentioned flange 27; and, on the other hand, the cylindrical body 26 is projectingly provided with the engagement ring 31 for rotatable engagement with the connecting part 4, and accommodates therein a cylinder 33 provided with a flange 32 to be coupled directly or indirectly with the mentioned flange 28. Push and pull bolts 34, 35 for adjustment of the slide bearing 23 provided on both sides of the slide bearing cause a position of the intermediate support shaft 22 supporting the driving lever and a position of the slide bearing 23 axially supporting the intermediate support shaft 22 to change in the axial direction. More specifically, after loosening the fastening bolts 25, the push and pull bolts 34, 35 are advanced to the right in the drawing. Then, all or a part of the adjusting lever 38 held between the flange 27 provided on the end of the body 26 of the driving lever and the flange 29 provided on the cylinder 30 fitted in the body 26 are removed, and a new adjustment is placed between the flanges 28, 29 on the opposite side so as to conform to the movement of the positions of the intermediate support shaft 22 and the slide bearing 23. Thus, the fulcrum P is moved to the right and the ratio of L1 to L2 is changed, though the full length L remains unchanged. The angle θ2 of the driven lever of the linkage is changed in accordance with the mentioned ratio change. For example, in a device in which θ2 is set to 35° by establishing a position of the fulcrum P so that the full length L of the driving lever is 979 mm which is kept constant, L1 is 447 mm, and L2 is 532 mm, when the position of the fulcrum P is shifted to the action point side by 30 mm which is expressed as $\Delta L=30$ herein, the inclination θ2 of the corresponding driven lever is changed to 39.7°, thus it is calculated that $\Delta\theta 2$ is 4.7°.

Figure 5A:
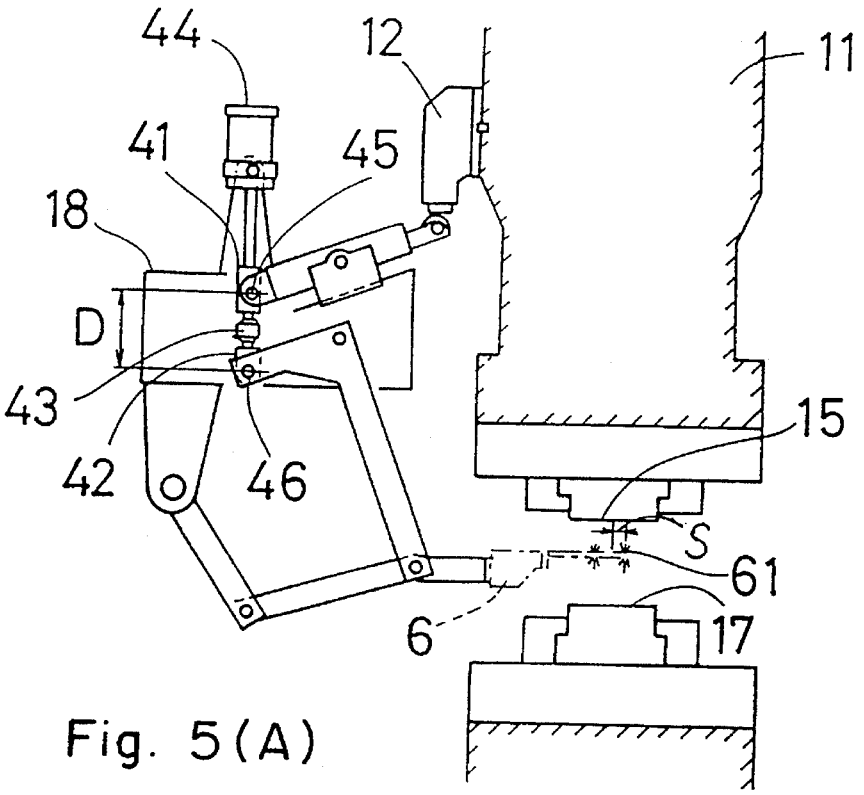
FIG. 5 (A) and FIG. 5 (B) are front views for explaining the adjustment function of the jet position at the top end of the blowing and spraying assembly according to the present invention.
Figure 5B:
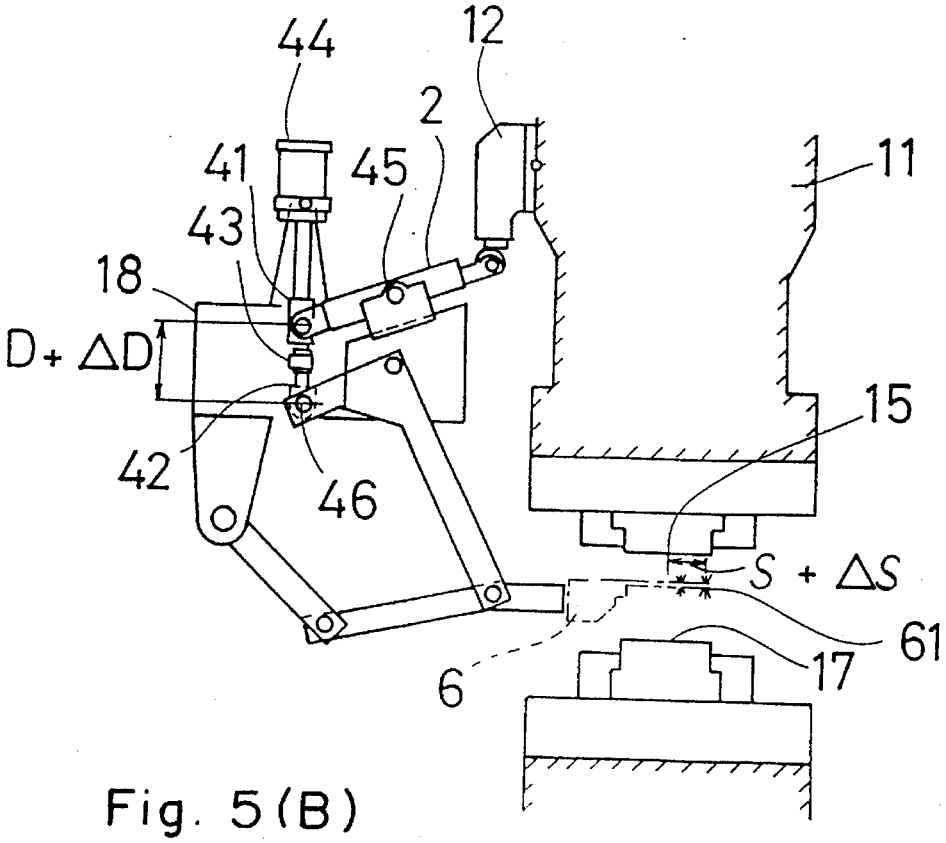
Figure 6:
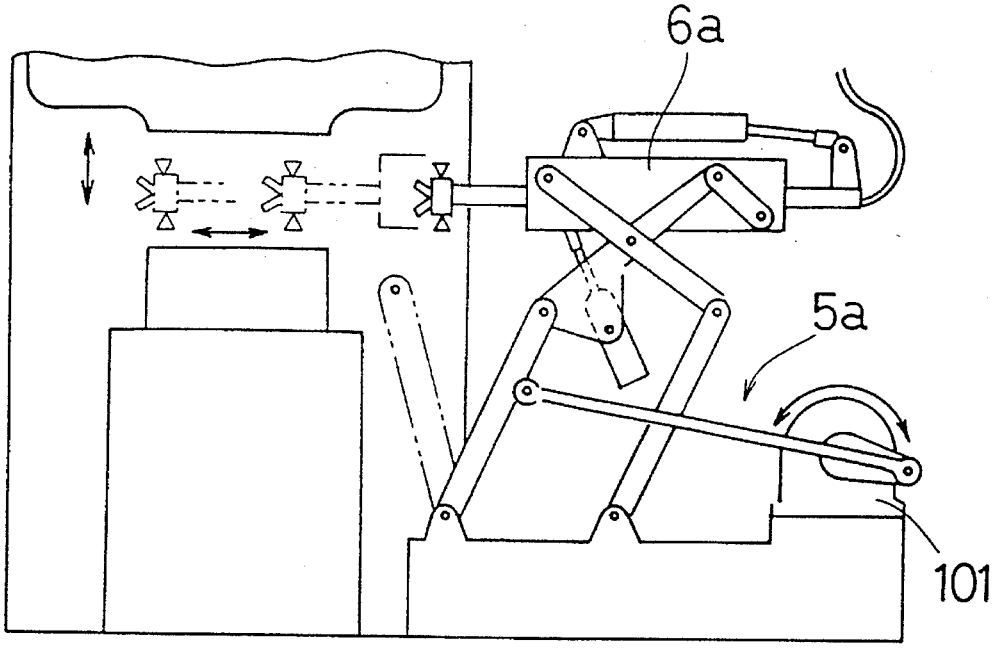
Fig.6 Prior Art
FIG. 6 is a front view showing a prior art device noted above.
Figure 7:
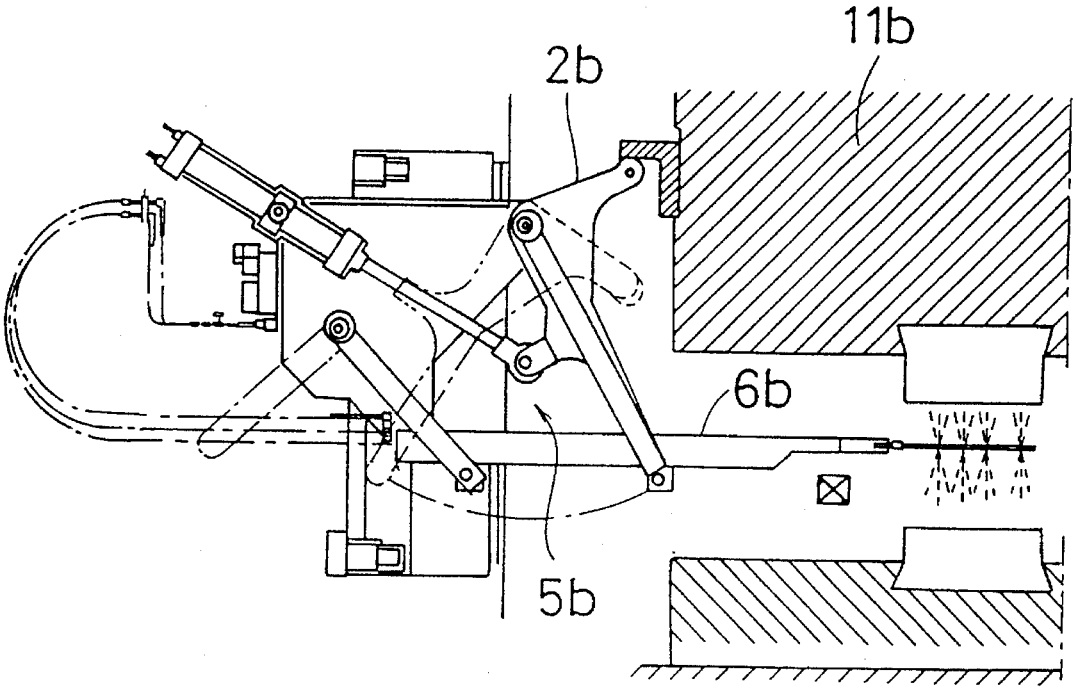
Fig.7 Prior Art
FIG. 7 is a front view showing another prior art device noted above.

The engagement ring 31 provided on another end of the driving lever 2 engages rotatably with the connecting fitting 41 of the connecting part 4 through the pin 45 to form a reaction point R. A connecting nut 43 connects telescopically the connecting fitting 41 to the connecting fitting 42 which is connected to the linkage 5 located below. The connecting nut forms a turnbuckle mechanism to change the distance between the two connecting fittings. More specifically, in FIG. 5(A), a distance between the pin 45 and the pin 46 is D, and a maximum distance "s" permitted for the jet 61 on the top end of the blowing and spraying assembly to enter from the stroke center. On the other hand, in FIG. 5(B), when turning the connecting nut 43 to extend the original distance to $D+\Delta D$, the maximum distance permitted for the jet 61 to enter between the two dies is increased to $s+\Delta s$. In this manner, the maximum distance "s" permitted for the jet 61 on the top end of the assembly to enter from the stroke center can be adjusted by means of the mentioned connecting nut 43. As a result, since the connecting part has a function of adjusting the position of the top end of the blowing and spraying assembly 6, the blowing and spraying assembly is adjusted to an optimum position, in association with the mentioned adjustment of the stroke S.

What is claimed is:

1. A device for moving a blowing and spraying assembly for dies used in a forging press, the forging press including a reciprocating slide, comprising:

a driving lever connectable with the reciprocating slide, said driving lever defining a given full length (L) and being mounted to pivot about a fulcrum such that the full length (L) is divided into partial lengths (L1) and (L2);

a roller connected to one end of said driving lever which is connectable with the reciprocating slide, and an engagement ring connected to the other end of said driving lever; and linkage means connected to said driving lever and to the spraying assembly, said linkage means being connected to said engagement ring of said driving lever by a connecting part, wherein said connecting part includes a connecting fitting engaging said engagement ring, a further connecting fitting engaging said linkage means and a connecting nut connected, telescopically to said connecting fitting and said further connecting fitting.

2. The device for moving a blowing and spraying assembly as defined in claim 1, further comprising:

a frame;

a slide bearing defining a plurality of through holes;

an intermediate support shaft mounted to said slide bearing and defining the fulcrum about which said driving lever pivots; and a plurality of fastening bolts received within a respective one of said through holes for fastening said slide bearing to said frame, wherein said driving lever includes a cylindrical body having two ends each defining a flange and a cylinder situated therein and at each end of the cylindrical body, each defining a flange which is coupled to a respective one of the cylindrical body flanges.

* * * * *